US006656236B1

(12) United States Patent
Coleman et al.

(10) Patent No.: US 6,656,236 B1
(45) **Date of Patent: *Dec. 2, 2003**

(54) CONSTANT HEATING VALUE AQUEOUS FUEL MIXTURE AND METHOD FOR FORMULATING THE SAME

(75) Inventors: Gerald N. Coleman, Peoria, IL (US); James E. Sibley, Metamora, IL (US)

(73) Assignee: Clean Fuel Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/208,660

(22) Filed: Dec. 10, 1998

Related U.S. Application Data

(60) Provisional application No. 60/069,383, filed on Dec. 12, 1997.

(51) Int. Cl.[7] ..... C10L 1/32
(52) U.S. Cl. ..... 44/301; 44/302
(58) Field of Search ..... 44/302, 301

(56) References Cited

U.S. PATENT DOCUMENTS

| | | | | | |
|---|---|---|---|---|---|
| 4,002,435 | A | | 1/1977 | Wenzel et al. | 44/51 |
| 4,083,698 | A | * | 4/1978 | Wenzel | 44/302 |
| 4,755,325 | A | | 7/1988 | Osgerby | 252/314 |
| 5,156,114 | A | | 10/1992 | Gunnerman | 123/1 A |
| 5,245,953 | A | | 9/1993 | Shimada et al. | 123/25 E |
| 5,259,851 | A | | 11/1993 | Genova et al. | 44/302 |
| 5,284,492 | A | * | 2/1994 | Dubin | 44/301 |
| 5,360,458 | A | | 11/1994 | Forsberg et al. | 44/301 |
| 5,445,656 | A | | 8/1995 | Marelli | 44/301 |
| 5,505,876 | A | | 4/1996 | Rivas et al. | 252/311 |
| 5,560,344 | A | | 10/1996 | Chan | 123/515 |
| 5,603,864 | A | | 2/1997 | Silva et al. | 252/311.5 |
| 5,622,920 | A | | 4/1997 | Rivas et al. | 507/232 |
| 5,669,938 | A | * | 9/1997 | Schwab | 44/301 |
| 5,743,922 | A | | 4/1998 | Peter-Hoblyn et al. | 44/301 |
| 5,873,916 | A | * | 2/1999 | Cemenska et al. | 44/301 |
| 6,302,929 | B1 | * | 10/2001 | Gunnerman | 44/302 |

FOREIGN PATENT DOCUMENTS

| | | | |
|---|---|---|---|
| EP | 0 475 620 | 3/1992 | C10L/1/32 |

* cited by examiner

*Primary Examiner*—Cephia D. Toomer
(74) *Attorney, Agent, or Firm*—Sierra Patent Group, Ltd.

(57) ABSTRACT

A method of formulating a fuel emulsion composition for use in a specified compression ignition engine in which the fuel composition includes a hydrocarbon petroleum distillate, purified water; alcohol; and an additive composition comprising various ingredients. The types and amounts of the fuel and alcohol are selected so that the sum of its net heating value (lower heating value * percent of total composition) and the net heating value of the additive composition yields a net heating value of the aqueous fuel composition that is within the operating parameters for fuel heating values for the engine.

63 Claims, 1 Drawing Sheet

CONSTANT HEATING VALUE AQUEOUS FUEL MIXTURE AND METHOD FOR FORMULATING THE SAME

This application is based, in part, on U.S. provisional patent application Ser. No. 60/069,383 filed December 12, 1997, the disclosure of which is incorporated by reference.

FIELD OF THE INVENTION

This invention relates to aqueous fuel compositions and more particularly, to aqueous fuel compositions whose ingredients are combined in relative proportion so as to achieve a final fuel formulation having a somewhat constant heating value regardless of the hydrocarbon used and the amount and type of alcohol selected. Aqueous fuel emulsion compositions are desirable for use in internal combustion engines because when combusted they produce reduced levels of nitrogen oxide (NOx) emissions.

BACKGROUND OF THE INVENTION

One problem with using diesel-fueled engines is to the relatively high flame temperatures reached during combustion. Such high temperatures increase the tendency for the production of nitrogen oxides (NOx). These are formed from both the combination of nitrogen and oxygen in the combustion chamber and from the oxidation of organic nitrogen species in the fuel. Nitrogen oxides comprise a major irritant in smog and are believed to contribute to tropospheric ozone, which is a known threat to health. Environmental considerations and government regulations have increased the need to reduce NOx production. Various methods for reducing NOx production include the use of catalytic converters, engine timing changes, exhaust recirculation, and the burning of "clean" fuels. These methods are generally too expensive and/or too complicated to be placed in widespread use.

The rates at which NOx are formed are related to the flame temperature. It has been shown that a small reduction in flame temperature can result in a large reduction in the production of nitrogen oxides. One approach to lowering the flame temperature is to inject water in the combustion zone, however; this requires costly and complicated changes in engine design. The latest attempt to use water to reduce flame temperature is the use of aqueous fuels, i.e., incorporating both water and fuel into an emulsion.

There are various ingredients typically used to make a fuel emulsion including a hydrocarbon, water, alcohol, surfactants, and other additives. Some of these ingredients have a net heat of combustion or lower heating value which means the lower heating value of the final fuel changes based on the amount and type of ingredients selected. Engine manufacturers, however, typically size the engine fuel system based on the heating value per gallon of fuel and cannot tolerate significant variations in final fuel formulations. Thus many aqueous fuel emulsions are formulated with very specific recipes and do not allow for fuel ingredient variability.

For a number of reasons, it would be desirable to develop an aqueous fuel emulsion that can incorporate a wide variety of hydrocarbon sources and can tolerate varying amounts and types of alcohols. For example, alcohols are often used to prevent the aqueous fuel emulsion from freezing at lower ambient temperatures. However, the use of alcohols should be minimized for cost and engine ignition quality considerations. Clearly, there are some engine operating conditions that would warrant increasing the alcohol content of the fuel formulation notwith-standing the extra cost. Similarly, there are some engine operating considerations that would warrant using various hydrocarbon sources, based on the hydrocarbon availability and cost. Thus, it is apparent that there are various engine operating conditions that would benefit from variations in aqueous fuel emulsion formulations.

DISCLOSURE OF THE INVENTION

In general, the invention features a method of formulating a substantially ashless fuel composition that includes: (a) hydrocarbon petroleum. distillate; (b) purified water; (c) alcohols; and (d) an additive package composition comprising various ingredients where a single ingredient may perform multiple functions. The fuel composition preferably is in the form of an aqueous fuel emulsion that is stable at temperatures and pressures encountered during recirculation in a compression ignited engine. The fuel emulsion can be either water continuous emulsion or more preferably a fuel continuous emulsion. More importantly, the aqueous fuel composition can be tailored for specific engine operating conditions by varying the types and amounts of hydrocarbon petroleum distillate and alcohol used while maintaining said aqueous fuel composition within a specified range of acceptable lower heat value.

In preferred embodiments, the fuel emulsion composition includes a hydrocarbon petroleum distillate, purified water, alcohol, and an additive composition that includes an emulsifier and may include other additives such as cetane improvers, surfactants, corrosion inhibitors, lubricity additives, biocides, and antifoam agents.

In the fuel continuous embodiment, the amount of the hydrocarbon petroleum distillate preferably is between about 60 weight percent and about 95 weight percent of the fuel composition, more preferably between about 70 weight percent and about 90 weight percent of the fuel composition.

The purified water preferably contains no greater than about 50 parts per million calcium and magnesium ions, and no greater than about 20 parts per million silicon. More preferably, the purified water contains no greater than about 2 parts per million calcium and magnesium ions, and no greater than about 1 part per million silicon. The amount of purified water preferably is between about 5 weight percent and about 40 weight percent of the fuel composition, more preferably between about 10 weight percent and about 30 weight percent of the fuel composition.

In the water continuous emulsion, the emulsifier preferably is selected from the group consisting of nonionic, anionic, and amphoteric emulsifiers, and combinations thereof. An example of a preferred alkyl amphoteric emulsifier for such water continuous fuel emulsion embodiment is one having at least 12 carbon atoms. A specific example is dihydroxyethyl tallow glycinate. The amount of the alkyl amphoteric emulsifier preferably is between about 0.01 weight percent and about 0.1 weight percent of the fuel composition.

In addition, the water continuous fuel emulsion embodiments includes an alkylphenolethoxylate (e.g., a polyethoxylated nonylphenol having between about 8 and 12 moles of ethylene oxide per mole of nonylphenol, more preferably about 9 moles of ethylene oxide per mole of nonylphenol), an alcohol ethoxylate, a fatty alcohol ethoxylate, an alkyl amine ethoxylate, or a combination thereof within the additive package. In the case of alkylphenol-ethoxylates, the ingredient preferably is present in an amount ranging from about 0.4 weight percent to about 1.0 weight percent of the fuel composition.

The water continuous fuel emulsion embodiment additive composition also may include an organophosphoric or carboxylic mono-, di-, or tri-functional acid having at least 12 carbon atoms. An example of a preferred acid is selected from the group consisting of di- and tri-acids of the Diels-Alder adducts of unsaturated fatty acids (preferably having between about 12 and about 22 carbon atoms) and mixtures thereof. For example, the acid may be a $C_{21}$ dicarboxylic acid derived from the Diels-Alder adduct of maleic anhydride and oleic acid. The amount of the mono-, di-, or tri-acid preferably is between about 0.04 weight percent and about 0.1 weight percent of the fuel composition, more preferably between about 0.04 weight percent and about 0.05 weight percent of the fuel composition.

The water continuous fuel emulsion additive composition also includes an alkanolamine. Examples of preferred alkanolamines include those selected from the group consisting of amino methyl propanol, triethanolamine, diethanolamine, and combinations thereof, with amino methyl propanol being preferred. The amount of the alkanolamine preferably is between about 0.05 weight percent and about 0.4 weight percent of the fuel composition, more preferably about 0.06 weight percent of the fuel composition.

The water continuous fuel emulsion additive composition further includes an aminoalkanoic acid. An example of a preferred aminoalkanoic acid is available from the Keil Chemical Division of Ferro Corporation under the trade designation "Synkad 828". The amount of aminoalkanoic acid preferably is between about 0.03 weight percent and 0.15 weight percent, more preferably between about 0.03 and about 0.05 weight percent.

The fuel continuous fuel emulsion additive package is comprised of a primary surfactant in combination with one or more surfactant stabilizers and enhancers. Preferred fuel continuous compositions include about 0.3% to about 1.0% by weight, preferably about 0.4% to about 0.6% total additive package.

The primary surfactants in the fuel continuous emulsions include charged amide surfactants, more preferably unsubstituted, mono- or di-substituted amides of saturated or unsaturated $C_{12}$–$C_{22}$ fatty acids. The primary surfactant in the fuel continuous emulsion composition is present in the range of about 3,000 ppm to about 10,000 ppm.

The disclosed additive package for the fuel continuous emulsion also includes one or more block-copolymers which act as a stabilizer of the primary surfactant and one or more high molecular weight polymeric dispersants. The disclosed block-copolymers include high molecular weight block copolymers, such as EO/PO block copolymers in the range of about 1,000 ppm to about 5,000 ppm. The disclosed high molecular weight polymeric dispersants are present in the range of about 100 ppm to about 1,000 ppm.

Finally, in some preferred embodiments of both water continuous and fuel continuous emulsions, the additive composition includes antifreeze and ignition delay modifiers (i.e. cetane improvers). The amount of antifreeze preferably is between about 2 weight percent and about 9 weight percent of the fuel composition. Examples of preferred antifreezes include $C_1$ to $C_3$ alcohols, methanol, ethanol and isopropanol. Preferred ignition delay modifiers are selected from the group consisting of nitrates, nitrites, peroxides, and combinations thereof. An example of a preferred ignition delay modifier is 2-ethyihexylnitrate. The amount of the ignition delay modifier preferably is between about 0.1 weight percent and about 0.4 weight percent of the fuel composition.

The components of the fuel emulsion composition, and the relative amounts thereof, are preferably selected such that the fuel emulsion composition is suitable for use in diesel engines. This includes varying the formula of the fuel emulsion to maintain the lower heating value of the fuel emulsion within a range for which the engine fuel system is designed. Moreover, the fuel emulsion composition is preferably ashless, is preferably stable at temperatures and pressures encountered during recirculation in compression ignited engines.

Other features and advantages of the invention will be apparent from the following description of the preferred embodiments thereof, and from the claims.

BRIEF DESCRIPTION OF THE DRAWING

The FIGURE is a schematic representation of an aqueous fuel emulsion blending station suitable for use with the present invention.

DESCRIPTION OF THE PREFERRED EMBODIMENTS

Figure 1:
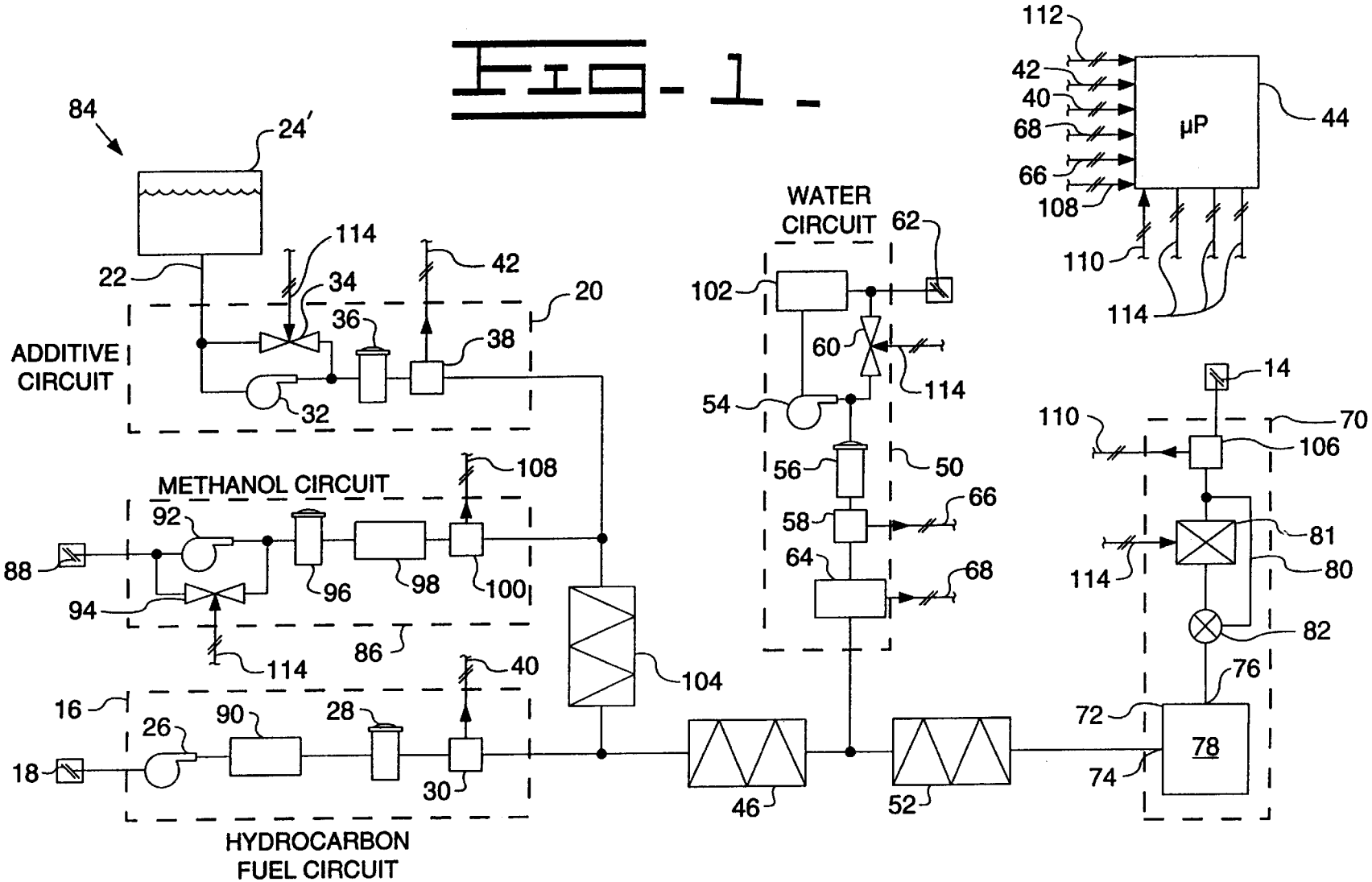

Contemplated fuel compositions for use with this invention include fuel and water in the form of an emulsion in which water is the continuous phase. The fuel composition is preferably ashless. "Ashless" means that, once the fuel components are combined, the level of particulates and coalescing ionic species is sufficiently low to allow long-term operation of the internal combustion engine (for example, substantially continuous operation for three months) without significant particulate and coalescing ionic species deposition on engine parts, including valve seats and stems, injectors and plug filters, and post-combustion engine parts such as the exhaust trains and turbo recovery units.

Examples of suitable fuels include hydrocarbon petroleum distillates such as diesel, naphtha, kerosene, and aliphatics and paraffinics, used alone or in combination with each other. Preferably, the hydrocarbon distillates are highly paraffinic, meaning they have a low aromatic content (e.g., below about 10 percent, and more preferably below about 3 percent). The preferred carbon chain lengths are in the range of $C_8$ to $C_{16}$.

In the water continuous embodiments, the fuel compositions include about 50% to about 80% by weight fuel, more preferably about 60% to about 70% fuel. The water functions as an extender and carrier of the fuel, although fuel continuous compositions may also be used, as described in more detail below. The water contained within the fuel formulation also results in reduced NOx and particulate emissions. The water is preferably purified such that it contains very low concentrations of calcium ions, magnesium ions, silicon, and other impurities. This is desirable because impure water contributes to ashing and engine deposit problems after long-term use, which can lead to wear, corrosion, and engine failure. Suitable purification techniques are well known and include distillation, ion exchange treatment, and reverse osmosis, with reverse osmosis being preferred due to lower cost and ease of operation. The water is preferably purified such that it contains no greater than about 50 parts per million calcium or magnesium ions (more preferably no greater than about 2 parts per million), and no greater than about 20 parts per million of silicon (more preferably no greater than about 1 part per million). Preferred compositions include about 20% to about 40% by weight water, more preferably about 30% to 36% water.

The water continuous fuel composition preferably includes additives. The additives are preferably selected so that the fuel composition is ashless. The amount of additive selected is preferably sufficiently high to perform its intended function. The amounts are preferably sufficiently low to control the fuel composition cost. The composition preferably includes an emulsifier, which facilitates the formation of a stable emulsion of the hydrocarbon fuel within the continuous water phase. A stable emulsion is desirable because a separate water phase will lead to combustion problems. Stability means no substantial phase separation in long term storage under typical storage conditions, for example up to about three months. A small amount of phase separation in the storage tank containing the fuel composition may be tolerated because pumping the fuel composition will ensure sufficient emulsification. Preferred emulsifiers are ashless and do not chemically react with other components in the fuel composition.

Examples of suitable emulsifiers include nonionic, anionic and amphoteric emulsifiers. Combinations of different types of emulsifiers may be used as well. Examples of suitable nonionic emulsifiers include alkylphenolethoxylates, alcohol ethoxylates, fatty alcohol ethoxylates, and alkyl amine ethoxylates. Of these, alkylphenolethoxylates and alcohol ethoxylates are preferred. Of the alkylphenolethoxylates, polyethoxylated nonylphenols having between 8 and 12 (preferably about 9) moles of ethylene oxide per mole of nonylphenol are preferred. Such nonylphenols are commercially available, e.g., from Rhone-Poulenc under the trade designation "Igepal CO-630". Preferred compositions include about 0.3% to about 0.6% [preferably 0.4% to 0.6%] by weight nonionic emulsifier, more preferably about 0.48%.

A suitable anionic emulsifier is a $C_{21}$ dicarboxylic acid derived from the Diels-Alder adduct of acrylic acid and oleic acid (commercially available from Westvaco under the trade designation "Diacid 1550™" ), which is neutralized with an alkanolamine to form a water soluble salt. Another suitable anionic emulsifier is a $C_{22}$ tricarboxylic acid derived from the Diels-Alder adduct of maleic anhydride and oleic acid (commercially available from Westvaco under the trade designation Tenax 2010™).

Suitable alkanolamine neutralizers include amino methyl propanol, triethanolamine, and diethanolamine, with amino methyl propanol (available from Angus Chemical under the trade designation AMP-95™) being preferred. Preferred compositions include about 0.04% to 0.1% by weight dicarboxylic acid (more preferably 0.04% to 0.05%), and about 0.05 to 0.4% by weight neutralizer (more preferably about 0.06%).

Preferred amphoteric emulsifiers are alkyl amphoteric emulsifiers containing $C_{16}$ and higher alkyl groups. An example of a suitable amphoteric emulsifier is dihydroxyethyl tallow glycinate, commercially available from Rhone-Poulenc under the trade designation 'Mirataine'. The amount of amphoteric emulsifier generally ranges from 0.01 to 0.1% by weight, and preferably is about 0.015%.

The water continuous fuel composition preferably includes a lubricant to improve the slip of the water phase and for continued smooth operation of the fuel delivery system. The amount of lubricant generally ranges from about 0.04% to 0.1% by weight, more preferably from 0.04% to 0.05% by weight. Suitable lubricants include a combination of mono-, di-, and tri-acids of the phosphoric or carboxylic types (preferably neutralized, e.g., with an alkanolamine), adducted to an organic backbone. The carboxylic types are more preferred because of their ashless character. Examples include mixed esters of alkoxylated emulsifiers in the phosphate form, and di- and tri-acids of the Diels-Alder adducts of unsaturated fatty acids. The organic backbone preferably contains about 12 to 22 carbons. A specific example of a suitable lubricant is Diacid 1550™, which is preferred due to its high functionality at low concentrations. Another example of a suitable lubricant is Tenax 2010™.

The water continuous fuel composition preferably includes a pH-maintaining additive capable of maintaining the pH of the fuel composition at a pH of at least about 9 throughout the combustion cycle of an internal combustion engine. Above a pH of about 9, the water in the fuel composition does not significantly attack the iron components of the engine. Examples of suitable additives include alkanolamines such as amino methyl propanol, triethanolamine, and diethanolamine, with amino methyl propanol being preferred. The amount of pH maintaining additive generally ranges from about 0.05% to 0.4% by weight, and preferably is about 0.06% by weight.

The water continuous fuel composition may also include a coupling agent (hydrotrope) to maintain phase stability at high temperatures and shear pressures. High temperature and shear pressure stability is required, for example, in compression ignited (diesel) engines because all the fuel delivered to the manifold may not be burned to obtain the required power load in a given cycle. Thus, some fuel may be recirculated back to the fuel tank. The relatively high temperature of the recirculated fuel, coupled with shear pressures encountered during recirculation, tends to cause phase separation in the absence of the coupling agent.

Examples of preferred coupling agents include di-and tri-acids of the Diels-Alder adducts of unsaturated fatty acids. A specific example of a suitable coupling agent is Diacid 1550™, neutralized with an alkanolamine to form a water soluble salt. Suitable alkanolamine neutralizers include amino methyl propanol triethanolamine, and diethanolamine, with amino methyl propanol preferred. The amount of the coupling agent typically ranges from about 0.04% to 0.1% by weight, more preferably 0.04 to 0.05%. The fuel composition may also include a corrosion inhibitor, preferably one that does not contribute a significant level of inorganic ash to the composition. Aminoalkanoic acids are preferred. An example of a suitable corrosion inhibitor is available from the Keil Chemical Division of Ferro Corporation under the trade designation "Synkad 828". Preferred compositions include about 0.05% by weight corrosion inhibitor.

The water continuous fuel composition may also include an ignition delay modifier (cetane improver) to improve fuel detonation characteristics, particularly where the fuel composition is used in compression ignited (diesel) engines. Examples include nitrates, nitrites, and peroxides. A useful ignition delay modifier is 2-ethylhexylnitrate, available from Ethyl Corporation under the trade designation "HiTec 4103". Preferred compositions include about 0.1% to 0.4% by weight ignition delay modifier.

An antifreeze may also be included in the water continuous fuel composition. Organic alcohols are preferred. Specific examples include methanol, ethanol, isopropanol, and glycols, with methanol being preferred. The amount of antifreeze preferably ranges from about 2% to about 9% by weight.

Biocides known to those skilled in the art may also be added, provided they are ashless. Antifoam agents known to those skilled in the art may be added as well, provided they are substantially ashless. A preferred antifoam agent is a hydrophoric silica polydimethyl siloxane dispersion available from Rhone-Poulenc under the trade designation "Antifoam 416". The amount of antifoam agent preferably is not more than 0.0005% by weight.

An example of a water continuous fuel composition has the following composition: 64.8% by weight hydrocarbon, 32.2% by weight water, 2% by weight methanol, 0.48% by weight Igepal CO-630™ and Mirataine™ (97% Igepal CO-630™, 3% Mirataine™ by weight), 0.04% Diacid 1550™, 0.06% AMP-95™, 0.05% Synkad 828™, 0.0005% Antifoam 416 and 0.37% 2_ethylhexylnitrate.

The preferred fuel emulsion compositions of the present invention include hydrocarbon petroleum distillate fuel and water in the form of an emulsion in which the fuel is the continuous phase. The preferred emulsion is a stable system with as little surfactant as possible. As indicated above, a stable emulsion is desirable because a separate water phase will lead to combustion problems. Stability means no substantial phase separation in long term storage under typical storage conditions, for example, up to about three months. High temperature, high pressure stability is also required to maintain the emulsion under operating conditions.

The preferred fuel continuous fuel emulsion composition is also preferably ashless. Preferred fuel continuous emulsion compositions include about 60% to about 95% by weight hydrocarbon petroleum distillate fuel, more preferably about 70% to about 90% hydrocarbon petroleum distillate fuel. As with the water continuous embodiments, the fuel continuous embodiments utilize suitable hydrocarbon petroleum distillate fuels such as kerosene, diesel, naphtha, and aliphatics and paraffinics, used alone or in combination with each other and may even include various synthetic fuels. Preferred diesels include but are not limited to, for example, EPA Emissions Certification diesel and standard number 2 diesel. Other suitable hydrocarbon petroleum distillate fuels also include high paraffinic, low aromatic hydrocarbon petroleum distillates having an aromatic content of less than about 10%, preferably less than about 3%.

The water phase of the fuel continuous emulsion contributes to the reduction of NOx and, in some cases, particulate emissions. The greater the amount of water, the greater the decrease in NOx emissions. The current upper limit of water is about 40%, above which the burning characteristics of the fuel make it's use impractical under normal conditions, i.e., with an acceptable amount of additives and relatively inexpensive hydrocarbon petroleum distillate. The preferred amount of purified water is between about 5 weight percent and about 40 weight percent of the fuel composition, more preferably between about 10 weight percent and about 30 weight percent of the fuel composition.

As indicated above, the water is preferably purified such that it contains very low concentrations of ions and other impurities, particularly calcium ions, magnesium ions, and silicon. The purified water preferably contains no greater than about 50 parts per million calcium and magnesium ions, and no greater than about 20 parts per million silicon. More preferably, the purified water has a total hardness of less than 10 parts per million and contains no greater than about 2 parts per million calcium and magnesium ions, and no greater than about 1 part per million silicon. As disclosed above, suitable purification techniques are well-known and include distillation, ion exchange treatment, and reverse osmosis, with reverse osmosis being preferred.

In a preferred embodiment the pH of the purified water is adjusted to about 4 to about 7, preferably from about 5 to about 6. The acidity helps the water droplets form more easily and thus enhances emulsion formation as well as having an anti-corrosion effect. The water can be acidified with any compatible acid, preferably an organic acid, more preferably citric acid.

The fuel continuous emulsion composition includes a surfactant package that facilitates the formation of a stable emulsion of the purified water within the continuous hydrocarbon petroleum distillate fuel phase. A preferred surfactant package is comprised of a primary surfactant in combination with one or more surfactant stabilizers and enhancers. Components of preferred surfactant packages are ashless and do not chemically react with other components in the fuel composition. Preferred fuel continuous emulsion compositions include about 0.3% to about 1.0% by weight, preferably about 0.4% to about 0.6% total surfactant package.

Examples of suitable primary surfactants include nonionic, anionic and amphoteric surfactants. Preferred primary surfactants include charged amide surfactants, more preferably unsubstituted, mono- or di-substituted amides of saturated or unsaturated $C_{12}$–$C_{22}$ fatty acids. The amide is preferably substituted with one or two groups selected independently of each other from straight, branched, unsubstituted and substituted alkyls or alkanols having 1 to 4 carbon atoms and aryls. An example of a preferred amide primary surfactant is a 1:1 fatty acid diethanolamide, more preferably a diethanolamide of oleic acid (commercially available as Schercomid SO-A from Scher Chemical). The primary surfactant is present in the fuel continuous emulsion composition in the range of about 3,000 ppm to about 10,000 ppm, more preferably about 5,000 ppm to about 6,000 ppm.

The surfactant package preferably includes one or more block-copolymers. The block copolymers of the surfactant package act as a stabilizer of the primary surfactant. Suitable block copolymers may have surfactant qualities, however; it is believed, this belief having no limitation on the scope or operation of this invention, that the unexpected, superior results of the present invention are a result of a 'synergistic' effect of the block copolymer in combination with the primary surfactant. The block copolymer acts as a stabilizer of the primary surfactant at the interface. Examples of suitable block-copolymers for the surfactant package include high molecular weight block copolymers, such as EO/PO block copolymers such as octylphenoxypolyethoxyethanol (a block copolymer produced by BASF as Pluronic 17R2). Examples of preferred block copolymers include Pluronic 17R2, Pluronic 17R4, Pluronic 25R2, Pluronic L43, Pluronic L31, and Pluronic L61, all commercially available from BASF. The block copolymer is present in the preferred fuel continuous emulsion composition in the range of about 1,000 ppm to about 5,000 ppm, more preferably about 2,000 ppm to about 3,000 ppm.

The surfactant package preferably includes one or more high molecular weight polymeric dispersants. The polymeric dispersant acts as a surfactant enhancer/stabilizer, stabilizing the primary surfactant and contributing to the synergistic combination of the primary surfactant and block copolymer. A preferred polymeric dispersant is Hypermer E-464 commercially available from ICI. Other suitable polymeric dispersants include Hypermer A-60 from ICI, a decyne diol nonfoaming wetter such as Surfinal-104 produced by Air Products, an amineoxide such as Barlox BX12 from Lonza, and Emulsan a bio-polymer surfactant from Emulsan. The polymeric dispersant is present in the preferred fuel continuous emulsion composition in the range of about 100 ppm to about 1,000 ppm, more preferably about 700 ppm to about 800 ppm.

The fuel continuous emulsion composition may also include one or more additives, for example, antifreezes, ignition delay modifiers, cetane improvers, stabilizers, lubricants, corrosion inhibitors, rheology modifiers, pH modifiers and the like. The amount of additive selected is preferably sufficiently high to perform its intended function and, preferably sufficiently low to control the fuel composition cost. The additives are preferably selected so that the fuel composition is ashless.

As with the water continuous compositions, the preferred fuel continuous compositions may include an antifreeze, such as an organic alcohol. Specific examples include methanol, ethanol, isopropanol, and glycols, with methanol being preferred. The amount of antifreeze is preferably less than about 15%, more preferably ranging from about 2% to about 9% by weight.

As disclosed above with respect to the water continuous compositions, the preferred fuel continuous composition may also include one or more ignition delay modifiers, preferably a cetane improver, to improve fuel detonation characteristics, particularly where the fuel composition is used in compression ignited engines. Examples include nitrates, nitrites, and peroxides. A preferred ignition delay modifier is 2-ethylhexylnitrate (2-EHN), available from Ethyl Corporation under the trade designation "HiTec 4103". Ammonium nitrate can also be used as a known cetane improver. Preferred compositions include about 0.1% to 0.4% by weight ignition delay modifier.

The fuel composition may include one or more lubricants to improve the lubricity of the fuel composition and for continued smooth operation of the fuel delivery system. Many conventional common oil-soluble and water soluble lubricity additives may be used and can be effective in amounts below about 200 ppm. The amount of lubricant generally ranges from about 0.04% to 0.1% by weight, more preferably from 0.04% to 0.05% by weight. An example of a suitable lubricants include a combination of mono-, di-, and tri-acids of the phosphoric or carboxylic types, adducted to an organic backbone. The organic backbone preferably contains about 12 to 22 carbons. Examples include Lubrizol 522A and mixed esters of alkoxylated surfactants in the phosphate form, and di- and tri-acids of the Diels-Alder adducts of unsaturated fatty acids. The carboxylic types are more preferred because of their ashless character. A specific example of a suitable lubricant is Diacid 1550™ (Atrachem Latol 1550 or Westvaco Chemicals Diacid 1550), which is preferred due to its high functionality at low concentrations. The Diacid 1550 also has nonionic surfactant properties. Neutralization of the phosphoric and carboxylic acids, preferably with an alkanolamine, reduces possible corrosion problems caused as a result of the addition of the acid. Suitable alkanolamine neutralizers include amino methyl propanol, triethanolamine, and diethanolamine, with amino methyl propanol (available from Angus Chemical under the trade designation "AMP-95") being in about 0.05 to 0.4% by weight neutralizer, more preferably about 0.06%.

With fuel being the continuous phase and the use of highly purified water, there is a low potential for corrosion and erosion, however; the fuel composition may also include one or more corrosion inhibitors, preferably one that does not contribute a significant level of inorganic ash to the composition. One example is amino methyl propanol (available from Angus Chemical under the trade designation "AMP-95". The addition of citric acid will also inhibit corrosion via a small change in the pH of the water; citric acid also enhances the formation of the emulsion. Aminoalkanoic acids are preferred. An example of another suitable corrosion inhibitor is available from the Keil Chemical Division of Ferro Corporation under the trade designation "Synkad 828". Preferred compositions include about 0.01% to about 0.05% by weight corrosion inhibitor.

Biocides known to those skilled in the art may also be added, provided they are ashless. Antifoam agents known to those skilled in the art may be added as well, provided they are ashless. The amount of antifoam agent preferably is not more than 0.0005% by weight.

The preferred fuel continuous emulsion composition may also include one or more coupling agents (hydrotropes) to maintain phase stability at high temperatures and shear pressures. High temperature and shear pressure stability is required, for example, in compression ignited (diesel) engines because all the fuel delivered to the injectors may not be burned to obtain the required power load in a given cycle. Thus, some fuel may be recirculated back to the fuel tank. The relatively high temperature of the recirculated fuel, coupled with the shear pressures encountered during recirculation, tends to cause phase separation in the absence of the coupling agent. Examples of preferred coupling agents include di-and tri-acids of the Diels-Alder adducts of unsaturated fatty acids. A specific example of a suitable coupling agent is Diacid 1550, neutralized with an alkanolamine to form a water soluble salt. Suitable alkanolamine neutralizers include amino methyl propanol triethanolamine, and diethanolamine, with amino methyl propanol preferred. The amount of the coupling agent typically ranges from about 0.04% to 0.1% by weight, more preferably 0.04 to 0.05%.

The preferred fuel continuous emulsion composition can include additives that perform multiple functions. For example, Diacid 1550 acts as a surfactant, lubricant, and coupling agent and citric acid has both emulsion enhancement and corrosion inhibitory properties. Similarly, AMP-95 acts as a neutralizer and helps maintain the pH of the fuel composition.

Many of the components of the fuel compositions, both water continuous and fuel continuous, have a net heat of combustion, or lower heating value. For example, the lower heating value for methyl alcohol, used as an antifreeze, is approximately 8,600 Btu/lb or 57,000 Btu/gallon, while an alternative antifreeze, ethyl alcohol, has a lower heating value of 11,600 Btu/lb or 76,300 Btu/gallon. The lower heating value for common hydrocarbon fuel can vary from 18,820 Btu/lb (specific gravity: 0.76 and 119,164 Btu/gallon) to 18,300 Btu/lb (specific gravity: 0.88 and 133,150 Btu/gallon). Engine manufacturers size the engine fuel system based on the heating value per gallon of the fuel. It is preferable to keep the lower heating value of the fuel composition within the range acceptable for the engine in which it is to be used and still be able to use a wide variety of hydrocarbon sources and alcohols. The proportions of the components of the fuel having a net heat of combustion are adjusted so that the heating value per gallon of the final fuel composition is relatively constant regardless of the hydrocarbon used or the amount or type of alcohol selected.

Turning now to the FIGURE, there is shown a schematic representation of a fuel emulsion blending system 12 having a plurality of ingredient inlets and a fuel emulsion outlet 14. The illustrated blending system is particularly useful for the fuel continuous emulsions or other emulsions where the additives are not water soluble. It is fully contemplated that one skilled in the art could make the suitable changes to the disclosed blending system for water continuous emulsions or other emulsions using water soluble additives.

As seen therein, the preferred embodiment of the fuel blending system 12 includes four fluid circuit inlets 18,22, 62,88 and a fuel emulsion outlet 14. A first fluid circuit 16 is adapted for receiving hydrocarbon fuel at a first ingredient inlet 18 from a source of hydrocarbon fuel (not shown) and a second fluid circuit 20 adapted for receiving fuel emulsion additives at a second ingredient inlet 22 from an additive storage tank 24 or similar such source of fuel emulsion additives. A third fluid circuit 50 is adapted for receiving water at the third ingredient inlet 62 from a source of water (not shown) while the fourth fluid circuit 86 is adapted for receiving methanol at the fourth ingredient inlet 88 from an appropriate source of methanol (not shown).

The first fluid circuit 16 includes a fuel pump 26 for transferring the hydrocarbon fuel, preferably a diesel fuel (although other hydrocarbon fuels can be used), from the source of hydrocarbon fuel to the blending system 12 at a selected flow rate, a 10 micron filter 28, and a flow measurement device 30 adapted to measure the flow rate of the incoming hydrocarbon fuel stream. In addition, the first fluid circuit 16 includes a heater 90 or other means for heating the hydrocarbon fuel component to a specified minimum temperature (e.g. 10 degrees C.). Likewise, the second fluid circuit 20 also includes a pump 32 for transferring the fuel emulsion additives from the storage tank 24 where the additives are maintained at a specified minimum temperature to the blending system 84 at a prescribed flow rate. The fuel additive flow rate within the second fluid circuit 20 is controlled by a flow control valve 34 interposed between the additive storage tank 24 and the fuel emulsion additive pump 32. As with the first fluid circuit 16, the second fluid circuit 20 also includes a filter 36 and a flow measurement device 38 adapted to measure the flow rate of the incoming additive stream. The signals 40,42 generated from the flow measurement devices 30,38 associated with the first and second fluid circuits are further coupled as inputs to a blending system controller 44.

The fourth fluid circuit 86 includes a pump 92 and flow control valve 94, filter 96, heating element 98 and a flow measurement device 100. The pump 92, filter 96, heater 98, and flow measurement device 100 are serially arranged within the fourth fluid circuit 86. The methanol flow rate within the fourth fluid circuit 86 is preferably controlled using the flow control valve 94 which is interposed between the methanol source (not shown) and the pump 92 proximate the fourth ingredient inlet 88. The final or third fluid circuit 50 is the water fluid circuit that preferably includes a water purification system 102 such as a reverse osmosis purification system that heats and purifies the supplied water to prescribed temperatures and levels of purity, respectively. This third fluid circuit 50 also includes a water pump 54 and water flow control valve 60 for transferring the purified water at a selected flow rate to the blending system 84. As with the earlier described embodiment, the third fluid circuit 50 also includes a flow measurement device 58 adapted to measure the flow rate of the incoming purified water stream and a specific conductance measurement device 64 adapted to monitor the quality of the water supplied to the blending system 84.

The operation of the fuel emulsion blending system 84, involves selective mixing of the ingredients from each of the fluid circuits. Specifically, the fourth fluid circuit 86 transporting the methanol and the second fluid circuit 20 adapted for supplying the fuel additives are coupled together and subsequently mixed together using an in-line mixer 104. The resulting mixture of methanol and fuel additives is then joined with the first fluid circuit 16 supplying the hydrocarbon fuel component. Another in-line mixer 46 is used to mix the hydrocarbon fuel, fuel additives and methanol together. The purified water stream supplied via a third fluid circuit 50 is then added to the mixture and subsequently mixed together using yet another in-line mixer 52. The resulting mixture or combination of hydrocarbon fuel, fuel emulsion additives, methanol and purified water are fed into an emulsification station 70. The emulsification station 70 includes an aging reservoir 72 and high shear mixing apparatus. The aging reservoir 72 includes an inlet 74, an outlet 76 and a high volume chamber 78 or reservoir. The preferred embodiment of the blending system 12 operates using an aging time that is a function of emulsion temperature. For example, a three minute aging time would be appropriate for room temperature mixture of the aqueous fuel emulsion. Thus, in the three minute aging time a blending system operating at an output flow rate of about 15 gallons per minute would utilize a 45 gallon tank as an aging reservoir. The incoming streams of hydrocarbon fuel, fuel emulsion additives, methanol, and purified water are fed into the aging reservoir 72 at a location that preferably provides continuous agitation to the reservoir. Alternatively, the aging reservoir could include a mechanical mixing device associated therewith. The preferred embodiment of the blending system 12 also includes a continuous rotor-stator dispersion mill 81, such as the Kady Infinity model manufactured by Kady International in Scarborough, Me., disposed downstream of the aging reservoir 72 which provides the final aqueous fuel emulsion at the blending system outlet 14.

The signals 40,42,66,108 generated from the flow measurement devices associated with the four fluid circuits together with the signals 68,110 generated by the specific conductance measurement device 64 in the third fluid circuit 50 and the final emulsion density and viscosity measurement device 106 are provided as inputs to the blending system controller 44. The blending system controller 44 also accepts various operator inputs 112 such as preferred alcohol content or engine specifications, by way of example, and provides output control signals 114 for the flow control valves in selected fluid circuits to achieve the desired heating value of the fuel emulsion composition.

For optimum viscosity and stability in a water continuous fuel emulsion, a prescribed percentage of the fuel mixture flow (i.e. 10–50%) should bypass the dispersion mill 81. Such bypass flow can be accomplished using a bypass conduit 80 and associated valve 82 located within or near the emulsification station 70. Bypassing a prescribed percentage of the mixture flow around the dispersion mill 81 yields a final fuel emulsion having a bi-modal droplet size distribution.

As indicated above, the blending system controller 44 accepts as inputs the signals generated by the various flow measurement devices in the first, second, third and fourth fluid circuits, as well as any signals generated by the water quality measurement device together with various operator inputs and provides control signals for the flow control valve in selected fluid circuits. The illustrated embodiment of the blending system is preferably configured such that the hydrocarbon fuel stream is not precisely controlled but is precisely measured. Conversely, the purified water feed line, alcohol feed line and the fuel additive feed line are precisely controlled and precisely measured to yield a prescribed water blend fuel mix at a prescribed lower heating value. The illustrated embodiment also shows the hydrocarbon fuel, alcohol, purified water and fuel additive streams to be continuous feed so that the proper fuel blend ratio at the prescribed lower heating value is continuously delivered to the shear pump. Alternatively, however, it may be desirable to configure the blending system such that the purified water stream is precisely measured but not precisely controlled while precisely controlling and measuring the hydrocarbon fuel feed line, alcohol feed line, and the fuel additive feed line to yield a prescribed water blend fuel mix at the same or similar lower heating value.

The disclosed fuel compositions according to the invention, and particularly the fuel continuous emulsion can be used in internal combustion engines without substantially modifying the engine design. For example, the fuel compositions can be used without re-designing the engine to include in-line homogenizers. To enhance fuel efficacy, however, several readily implemented changes may be incorporated in the engine structure. For example, the capacity of the engine fuel system must be increased to use the fuel compositions in diesel engines. The increased capacity is a function of the percent water in the fuel emulsion. The engine fuel system capacity is typically scaled by the following ratio:

$$\frac{\text{Lower Heating Value of Diesel Fuel (Btu/gal)}}{\text{Lower Heating Value of Fuel Composition (Btu/gal)}}$$

In many cases, the engine fuel system capacity can be increased sufficiently by increasing the injector orifice size. Other engines may require an increase in the capacity of the injection pump. In addition, an increase in the capacity of the fuel transfer pump may be required. Alternatively, the engine may utilize the same fuel system capacity and merely realize a lower engine output (e.g. lower horsepower output).

Some additional modifications to the engine may be required to compensate for fuel compositions with cetane quality lower than diesel fuel. This may include advancing the fuel injection timing to improve operation at light load, during starting, and under warm up conditions. In addition, a jacket water aftercooler may be required to warm the intake air under light load conditions. Use of a block heater or inlet air heater may be required to improve cold starting capability. Still other modifications may be required when using the water continuous emulsions to counter the corrosive effects of the fuel or the low lubricity characteristics of the fuel or both.

The following Example should serve to further typify the nature of the invention but should not be construed as a limitation on the scope thereof.

A number of water continuous fuel emulsion compositions can be prepared as set forth below. A suitable method for blending the described formulations is detailed above, with reference to the FIGURE. As seen in the following tables, the ingredients, namely water, alcohol (methanol), and the hydrocarbon (naptha) and their proportions can be varied under the control of an blending equipment operator or the above-described blending system controller to yield a fuel formulation having a relatively constant heating value per gallon.

Formula "A"

| Component | Specific Gravity | Density (lb/gal) | % Mass | % Volume | Btu/lb | Btu/gal |
|---|---|---|---|---|---|---|
| Hydrocarbon | 0.763 | 6.366 | 64.500 | 70.137 | 18800 | |
| Water | 1.000 | 8.345 | 32.500 | 26.958 | | |

-continued

Formula "A"

| Component | Specific Gravity | Density (lb/gal) | % Mass | % Volume | Btu/lb | Btu/gal |
|---|---|---|---|---|---|---|
| Alcohol | 0.795 | 6.635 | 2.000 | 2.087 | 8590 | |
| CO-630 | 1.060 | 8.846 | 0.480 | 0.376 | | |
| DA1550 | 1.013 | 8.454 | 0.040 | 0.033 | | |
| Amp 95 | 0.942 | 7.861 | 0.060 | 0.053 | | |
| Synkad 828 | 1.110 | 9.263 | 0.050 | 0.037 | | |
| 2-EHN | 0.960 | 8.012 | 0.370 | 0.320 | | |
| Final Fuel | 0.829 | 6.918 | 100.00 | 100.00 | 12298 | 85072 |

Formula "B"

| Component | Specific Gravity | Density (lb/gal) | % Mass | % Volume | Btu/lb | Btu/gal |
|---|---|---|---|---|---|---|
| Hydrocarbon | 0.850 | 7.092 | 60.800 | 64.311 | 18372 | |
| Water | 1.000 | 8.345 | 36.200 | 32.541 | | |
| Alcohol | 0.795 | 6.635 | 2.000 | 2.261 | 8590 | |
| CO-630 | 1.060 | 8.846 | 0.480 | 0.407 | | |
| DA1550 | 1.013 | 8.454 | 0.040 | 0.035 | | |
| Amp 95 | 0.942 | 7.861 | 0.060 | 0.057 | | |
| Synkad 828 | 1.110 | 9.263 | 0.050 | 0.040 | | |
| 2-EHN | 0.960 | 8.012 | 0.370 | 0.346 | | |
| Final Fuel | 0.899 | 7.497 | 100.00 | 100.00 | 11342 | 85032 |

Formula "C"

| Component | Specific Gravity | Density (lb/gal) | % Mass | % Volume | Btu/lb | Btu/gal |
|---|---|---|---|---|---|---|
| Hydrocarbon | 0.850 | 7.092 | 58.300 | 60.920 | 18372 | |
| Water | 1.000 | 8.345 | 31.700 | 28.151 | | |
| Alcohol | 0.795 | 6.635 | 9.000 | 10.053 | 8590 | |
| CO-630 | 1.060 | 8.846 | 0.480 | 0.402 | | |
| DA1550 | 1.013 | 8.454 | 0.040 | 0.035 | | |
| Amp 95 | 0.942 | 7.861 | 0.060 | 0.057 | | |
| Synkad 828 | 1.110 | 9.263 | 0.050 | 0.040 | | |
| 2-EHN | 0.960 | 8.012 | 0.370 | 0.342 | | |
| Final Fuel | 0.888 | 7.406 | 100.00 | 100.00 | 11484 | 85054 |

The resulting heating value per gallon of the three formulations varied by no more than 0.05%.

From the foregoing, it should be appreciated that the present invention thus provides a fuel emulsion composition whose ingredients are combined in relative proportion so as to achieve a final fuel formulation having a somewhat constant heating value mixture and a method of formulating or blending such aqueous fuel emulsion compositions from a source of hydrocarbon fuel, a source of water, a source of alcohol, and a source of fuel emulsion additives. While the invention herein disclosed has been described by means of specific embodiments and processes associated therewith, numerous modifications and variations can be made thereto by those skilled in the art without departing from the scope of the invention as set forth in the claims or sacrificing all its material advantages.

What is claimed is:

1. A method for producing a fuel emulsion composition having a constant heating value, comprising:

blending a flow of additives with a flow of an antifreeze in a first in-line blending station to create a first composition;

blending a flow of hydrocarbon distillate fuel with said first composition in a second in-line blending station to produce a second composition;

blending a flow of purified water with said second composition in a third in-line blending station to produce a third composition;

mixing said third composition in an emusification station; and aging said third composition in a reservoir, said reservoir disposed in said emulsification station.

2. The method of claim 1, wherein said flow of additives and said flow of hydrocarbon distillate fuel are controlled at a constant temperature.

3. The method of claim 1, wherein said reservoir provides continuous agitation.

4. The method of claim 1, further comprising a shear mixing apparatus disposed in said reservoir.

5. The method of claim 1, wherein said purified water is purified using a reverse osmosis purification system.

6. The method of claim 1, wherein said fuel emulsion composition is a water continuous emulsion.

7. The method of claim 1, wherein said fuel emulsion composition is a fuel continuous emulsion.

8. The method of claim 1, wherein said hydrocarbon petroleum distillate is about 60 weight percent to about 95 weight percent of said fuel emulsion composition.

9. The method of claim 1, wherein said hydrocarbon petroleum distillate is about 70 weight percent to about 90 weight percent of said fuel emulsion composition.

10. The method of claim 1, wherein said purified water is about 5 weight percent to about 40 weight percent of said fuel emulsion composition.

11. The method of claim 1, wherein said purified water is about 10 weight percent to about 30 weight percent of said fuel emulsion composition.

12. The method of claim 1, wherein said purified water contains no greater than about 50 parts per million of calcium ions, contains no greater than about 50 parts per million of magnesium ions, and contains no greater than about 20 parts per million of silicon.

13. The method of claim 1, wherein said purified water contains no greater than about 2 parts per million calcium ions, contains no greater than about 2 parts per million magnesium ions, and contains no greater than about 1 parts per million silicon.

14. The method of claim 1, further comprising adjusting the pH of said purified water to a pH of about 4 to about 7.

15. The method of claim 1, further comprising adjusting the pH of said purified water to a pH of about 5 to about 6.

16. The method of claim 1, wherein said flow of additives perform multiple functions.

17. The method of claim 1, wherein said flow of additives includes a surfactant package comprising primary surfactants, block copolymers, and polymeric dispersants.

18. The method of claim 17, wherein said primary surfactant is present at about 3,000 parts per million to about 10,000 parts per million.

19. The method of claim 17, wherein said primary surfactant is selected from the group consisting of nonionic surfactants, anionic surfactants, and amphoteric surfactants.

20. The method of claim 17, wherein said primary surfactant is selected from the group consisting of unsubstituted, mono-substituted amides of saturated $C_{12}$–$C_{22}$ fatty acids, di-substituted amides of saturated $C_{12}$–$C_{22}$ fatty acids, unsubstituted, mono-substituted amides of unsaturated $C_{12}$–$C_{22}$ fatty acids, and unsubstituted di-substituted amides of unsaturated $C_{12}$–$C_{22}$ fatty acids.

21. The method of claim 20, wherein said mono-substituted amides and said di-substituted amides are substituted by substituents selected, independently of each other, from the group consisting of straight and branched, unsubstituted and substituted alkyls having 1 to 4 carbon atoms, straight and branched, unsubstituted and substituted alkanols having 1 to 4 carbon atoms, and aryls.

22. The method of claim 17, wherein said block copolymer is present at about 1,000 parts per million to about 5,000 parts per million.

23. The method of claim 17, wherein said block copolymer is an ethylene oxide/propylene oxide block copolymer.

24. The method of claim 17, wherein said polymeric dispersant is present at about 100 parts per million to about 1,000 parts per million.

25. The method of claim 1, wherein said antifreeze is about 2 to about 9 weight percent of said fuel emulsion composition.

26. The method of claim 1, wherein said antifreeze is selected from the group consisting of methanol, ethanol, isopropanol, and glycols.

27. The method of claim 1, further comprising an ignition delay modifier in said flow of additives.

28. The method of claim 27, wherein said ignition delay modifier is selected from a group consisting of nitrates, nitrites, peroxides, and combinations thereof.

29. The method of claim 1, further comprising adding a coupling agent formed into a water soluble salt to said flow of additives.

30. The method of claim 1, further comprising adding at least one of the group consisting of corrosion inhibitors, lubricity additives, biocides, and antifoams to said flow of additives.

31. The method of claim 1, further comprising adjusting net heat of combustion of said hydrocarbon distillate fuel to achieve said constant heating value.

32. The method of claim 1, wherein said additives are selected to result in the emulsion being ashless.

33. A fuel emulsion composition having a constant heating value resulting from the method comprising:

blending a flow of additives with a flow of an antifreeze in a first in-line blending station to create a first composition;

blending a flow of hydrocarbon distillate fuel with said first composition in a second in-line blending station to produce a second composition;

blending a flow of purified water with said second composition in a third in-line blending station to produce a third composition;

mixing said third composition in an emusification station; and aging said third composition in a reservoir, said reservoir disposed in said emulsification station.

34. The fuel emulsion composition of claim 33, wherein said flow of additives and said flow of hydrocarbon distillate fuel are controlled at a constant temperature.

35. The fuel emulsion composition of claim 33, wherein said reservoir provides continuous agitation.

36. The fuel emulsion composition of claim 33, further comprising a shear mixing apparatus disposed in said reservoir.

37. The fuel emulsion composition of claim 33, wherein said purified water is purified using a reverse osmosis purification system.

38. The fuel emulsion composition of claim 33, wherein said fuel emulsion composition is a water continuous emulsion.

39. The fuel emulsion composition of claim 33, wherein said fuel emulsion composition is a fuel continuous emulsion.

40. The fuel emulsion composition of claim 33, wherein said hydrocarbon petroleum distillate is about 60 weight percent to about 95 weight percent of said fuel emulsion composition.

41. The fuel emulsion composition of claim 33, wherein said hydrocarbon petroleum distillate is about 70 weight percent to about 90 weight percent of said fuel emulsion composition.

42. The fuel emulsion composition of claim 33, wherein said purified water is about 5 weight percent to about 40 weight percent of said fuel emulsion composition.

43. The fuel emulsion composition of claim 33, wherein said purified water is about 10 weight percent to about 30 weight percent of said fuel emulsion composition.

44. The fuel emulsion composition of claim 33, wherein said purified water contains no greater than about 50 parts per million of calcium ions, contains no greater than about 50 parts per million of magnesium ions, and contains no greater than about 20 parts per million of silicon.

45. The fuel emulsion composition of claim 33, wherein said purified water contains no greater than about 2 parts per million calcium ions, contains no greater than about 2 parts per million magnesium ions, and contains no greater than about 1 parts per million silicon.

46. The fuel emulsion composition of claim 33, further comprising adjusting the pH of said purified water to a pH of about 4 to about 7.

47. The fuel emulsion composition of claim 33, further comprising adjusting the pH of said purified water to a pH of about 5 to about 6.

48. The fuel emulsion composition of claim 33, wherein said additives can perform multiple functions.

49. The fuel emulsion composition of claim 33, wherein said flow of additives includes a surfactant package comprising primary surfactant, block copolymer, and polymeric dispersant.

50. The fuel emulsion composition of claim 49, wherein said primary surfactant is present at about 3,000 parts per million to about 10,000 parts per million.

51. The fuel emulsion composition of claim 49, wherein said primary surfactant is selected from the group consisting of nonionic surfactants, anionic surfactants, and amphoteric surfactants.

52. The fuel emulsion composition of claim 49, wherein said primary surfactant is selected from the group consisting of unsubstituted, mono-substituted amides of saturated $C_{12}$–$C_{22}$ fatty acids, di-substituted amides of saturated $C_{12}$–$C_{22}$ fatty acids, unsubstituted, mono-substituted amides of unsaturated $C_{12}$–$C_{22}$ fatty acids, and unsubstituted di-substituted amides of unsaturated $C_{12}$–$C_{22}$ fatty acids.

53. The fuel emulsion composition of claim 52, wherein said mono-substituted amides and said di-substituted amides are substituted by substituents selected, independently of each other, from the group consisting of straight and branched, unsubstituted and substituted alkyls having 1 to 4 carbon atoms, straight and branched, unsubstituted and substituted alkanols having 1 to 4 carbon atoms, and aryls.

54. The fuel emulsion composition of claim 49, wherein said block copolymer is present at about 1,000 parts per million to about 5,000 parts per million.

55. The fuel emulsion composition of claim 49, wherein said block copolymer is an ethylene oxide/propylene oxide block copolymer.

56. The fuel emulsion composition of claim 49, wherein said polymeric dispersant is present at about 100 parts per million to about 1,000 parts per million.

57. The fuel emulsion composition of claim 33, wherein said antifreeze is about 2 to about 9 weight percent of said fuel emulsion composition.

58. The fuel emulsion composition of claim 33, wherein said antifreeze is selected from the group consisting of methanol, ethanol, isopropanol, and glycols.

59. The fuel emulsion composition of claim 33, further comprising an ignition delay modifier in said flow of additives.

60. The fuel emulsion composition of claim 59, wherein said ignition delay modifier is selected from a group consisting of nitrates, nitrites, peroxides, and combinations thereof.

61. The fuel emulsion composition of claim 33, further comprising adding a coupling agent formed into a water soluble salt to said flow of additives.

62. The fuel emulsion composition of claim 33, further comprising adding at least one of the group consisting of corrosion inhibitors, lubricity additives, biocides, and antifoams to said flow of additives.

63. The fuel emulsion composition of claim 33, further comprising adjusting net heat of combustion of said hydrocarbon distillate fuel to achieve said constant heating value.

* * * * *